United States Patent [19]

Davis

[11] 3,934,384

[45] Jan. 27, 1976

[54] CLOSURE SEAL MEMBER AND FIXED FRAME ASSEMBLY UTILIZING THE SAME

[75] Inventor: James L. Davis, St. Louis, Mo.

[73] Assignee: H. H. Robertson Company, Pittsburgh, Pa.

[22] Filed: Jan. 7, 1974

[21] Appl. No.: 431,064

[52] U.S. Cl. ..... 52/397; 52/476; 52/728

[51] Int. Cl.[2] ..... A04B 1/16

[58] Field of Search ..... 52/288, 397, 400, 401, 52/403, 476, 716–718, 726, 727; 49/749

[56] References Cited

UNITED STATES PATENTS

| | | | |
|---|---|---|---|
| 1,356,855 | 10/1920 | Clifton | 52/397 |
| 1,530,717 | 3/1925 | Foote | 49/479 |
| 2,084,107 | 6/1937 | Parkinson | 52/401 |
| 2,682,087 | 6/1954 | Siering | 52/401 |
| 3,090,083 | 5/1963 | Emmerich | 52/400 |
| 3,112,534 | 12/1963 | Winnan | 52/401 |
| 3,201,909 | 8/1965 | Grun | 52/717 |
| 3,302,354 | 2/1967 | Mermell | 52/476 |
| 3,344,573 | 10/1967 | Martin et al. | 52/476 |

FOREIGN PATENTS OR APPLICATIONS

| | | | |
|---|---|---|---|
| 1,456,933 | 9/1966 | France | 52/397 |
| 1,034,347 | 7/1958 | Germany | 52/476 |
| 661,025 | 11/1951 | United Kingdom | 52/288 |
| 703,899 | 4/1966 | Italy | 52/403 |

*Primary Examiner*—Henry C. Sutherland
*Attorney, Agent, or Firm*—Harry B. Keck; George E. Manias

[57] ABSTRACT

A closure seal member for capping the perimeter recesses presented between a closure and the surrounding fixed frame assembly. The closure seal member includes a longitudinally rigid support member adapted for interlocking engagement with a frame member of the assembly; and a sealing strip carried at the exterior face of the support member, with a portion thereof positioned to be compressed between the angle member and the closure, and a portion thereof exposed to view. The sealing strip has end portions extending beyond the opposite ends of the support member. At the juncture of adjacent, angularly disposed frame members, the sealing strip end portions of adjacent seal members are engaged to provide a neat corner presentation. The overall length of the support member is less than that of the frame member. Field cutting of metal is avoided.

3 Claims, 11 Drawing Figures

CLOSURE SEAL MEMBER AND FIXED FRAME ASSEMBLY UTILIZING THE SAME

BACKGROUND OF THE INVENTION

1. Field of the Invention

This invention relates to fixed frame assemblies, and more particularly to an improved closure seal member for capping the perimeter recess of a fixed frame assembly.

2. Description of the Prior Art

In modern curtain wall constructions, vertical and horizontal metallic members are assembled as a grid to provide plural fixed frame assemblies each defining an opening. The openings receive closures, such as glazing panes, decorative panels and the like. See U.S. Pat. Nos. 3,016,993 (OWEN, Jan. 16, 1962); 3,038,568 (MORGAN, June 12, 1962).

In one type of construction, the closure is surrounded by the frame members and cooperates therewith to present interior and exterior perimeter recesses. Welts or sealing members, in the form of a continuous resilient strip or plural flexible elements, are introduced into each of the perimeter recesses, thereby retaining the closure within the frame assembly and providing a seal therebetween. See, for example, U.S. Pat. Nos. 2,174,279 (TONEY, Sept. 1939); 2,280,389 (EDWARDS, Apr. 1942); 3,344,573 (MARTIN et al., Oct. 1967). The welt or sealing member normally is formed from rubber or plastic and is extremely flexible. Installation of the sealing member requires a force to be applied thereto every half inch to one inch in order to drive it into the perimeter recess. Installation of such flexible sealing members is a time consuming operation.

In a second type of construction, the frame members are adapted to receive metallic or plastic perimeter closure retainer beads on one or both sides of the closure. See, for example, U.S. Pat. Nos. 2,765,057 (STIEFVATER, Oct. 1956); 2,811,754 (TOTH, Nov. 1957); 2,983,002 (MCEVOY et al., May 1961); 3,344,573 supra; 3,501,884 (DI CESARE, JR. et al., Mar. 1970). The major difficulty encountered in using metallic or plastic retainer beads is that extreme accuracy is required in cutting the bead to the required length. The length accuracy of the retainer beads is necessary in order to fit the field assembly frame assembly, and in order to form a neat corner presentation.

SUMMARY OF THE INVENTION

The principal object of this invention is to provide an improved closure sealing member which may be quickly and easily installed.

Another object of this invention is to provide an improved closure sealing member capable of compensating for greater tolerances in the closure thickness and in the perimeter recess of a fixed frame assembly.

Another object of this invention is to provide an improved sealing member which incorporates a sealing strip formed of rubber or plastic, which is interposed between the support member and the closure to provide a seal therebetween.

Still another object of this invention is to provide an improved sealing member by which neat corner presentations can be made while avoiding field cutting of metal components.

A still further object of this invention is to provide an improved sealing member wherein the longitudinally rigid metal support member may undergo thermal expansion and contraction without affecting the seal provided thereby.

In accordance with the present invention, a closure seal member is provided comprising an angle member having integral first and second arms presenting an exterior face and an interior face, and which is longitudinally rigid. A deflectible retaining arm integral with the second arm, confronts the interior face and is inclined relative to the second arm so as to form an acute angle therewith. A sealing strip, formed from resilient material such as rubber or plastic, overlies the exterior face of the first and second arms. The sealing strip extends beyond at least one and preferably both ends of the angle member.

The present sealing member is particularly adapted for use in a fixed frame assembly of polygonal configuration, having plural, angularly presented frame members surrounding a closure. The frame members include perimeter faces which confront the closure and define contiguous perimeter recesses at one assembly face. The frame assembly has plural interior corners each presented at the juncture of adjacent ones of the angularly presented frame members. One of the present sealing members is installed in each of the recesses. In accordance with the present improvement, the longitudinally rigid support member has an overall length which is less than the frame member, whereby at each of the junctures, the confronting ends of adjacent members are spaced apart. The exposed portion of the sealing strip carried by each of the support members has end portions extending beyond the opposite ends of the support member, whereby at each of the junctures, the end portions of adjacent sealing strips are engaged to provide a neat seal therebetween. Since the sealing strip is formed from relatively soft material, any excess material can either be pushed into the joint or trimmed off in the field. Since the length of the support member is less than the adjacent frame member, the support member is free to undergo thermal expansion and contraction without affecting the frame assembly or the seal provided by the sealing strips.

Glass panes of relatively large area can be caused to vibrate by intermittent wind loads and other vibration inducing loads. Should the vibration amplitude reach a critical value, the glass pane will shatter. Since the present closure member is retained in position by the deflectible arm, it provides a cushioning effect. The present sealing member additionally serves as a damper for absorbing vibrational energy.

DESCRIPTION OF THE PREFERRED EMBODIMENTS

Figure 2:
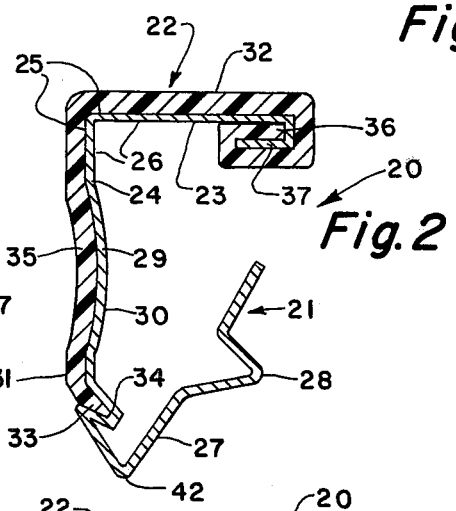
FIG. 2 is a cross-sectional view taken along the line 2—2 of FIG. 1.
Figure 1:
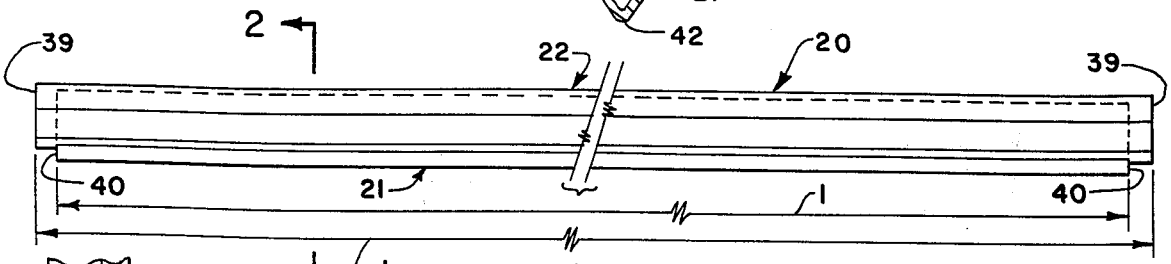
FIG. 1 is a broken side view of the closure seal member of this invention.

FIG. 1 illustrates a closure sealing member 20 comprising a longitudinally rigid support member 21 and a sealing strip 22. As best shown in FIG. 2, the rigid support member 21 comprises integral first and second arms 23, 24 presenting an exterior face 25 and an interior face 26. A deflectible retaining arm 27 is integral with and pivotal about an edge 42 of the second arm 24 remote from the first arm 23. The arm 27 confronts the interior face 26 and is inclined relative to the second arm 24 so as to form an acute angle therewith. The deflectible retaining arm 27 may be coextensive in length with the second arm 24. The deflectible retaining arm 27 presents a lengthwise rib 28 extending away from the interior face 26 of the second arm 24. The second arm 24 includes, intermediate of its opposite longitudinal sides, a lengthwise arch-shaped segment 29 presenting a convex surface 30 confronting the deflectible arm 27.

Figure 4:
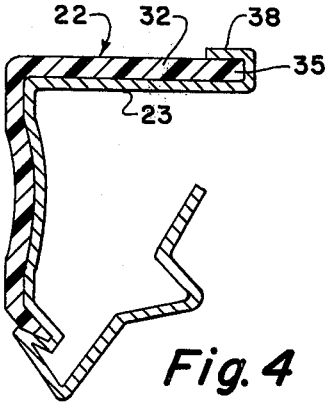
FIG. 4 is a cross-sectional view, similar to FIG. 2, illustrating an alternative configuration of the closure sealing member of this invention.

The sealing strip 22 is formed from relatively soft resilient material, such as rubber, plastic and the like. The sealing strip 22 includes a first lengthwise portion 31 overlying the exterior face 25 of the second arm 24 and a second lengthwise portion 32 overlying the exterior face 25 of the first arm 23. The first lengthwise portion 31 may have an edge 33 received in and retained by a V-shaped retainer 34 formed in the second arm 24. The first lengthwise portion includes an arch-shaped segment 35 corresponding to the segment 29 of the second arm 24. The second lengthwise portion 32 of the sealing strip 22 may have an edge 36 which surrounds and is retained by a re-entrant flange 37 formed in the first arm 23. Alternatively, as shown in FIG. 4, the edge 35 of the second lengthwise portion 32 may be surrounded by and retained by a re-entrant flange 38 of the first arm 23.

Figure 3:
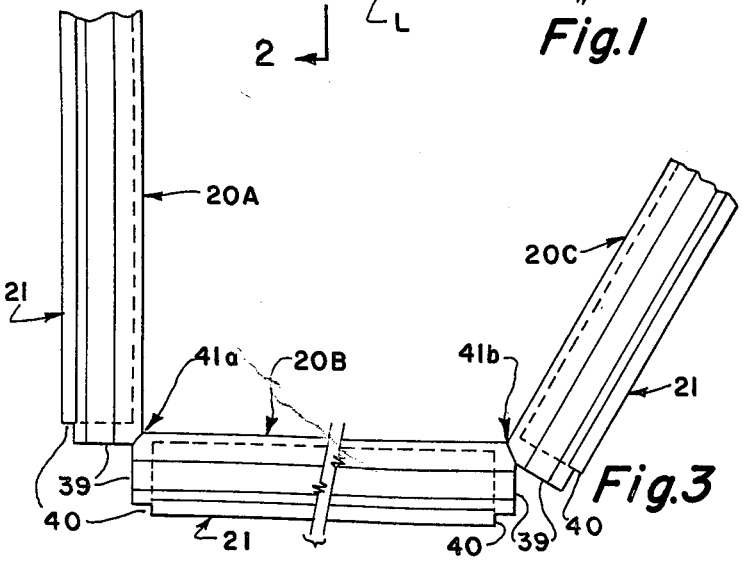
FIG. 3 is a broken, fragmentary elevation view of three of the present closure sealing members, illustrating the formation of corners.

In accordance with the present invention and as best illustrated in FIG. 1, the overall length L of the sealing strip 22 is greater than the length of the rigid support member 21, whereby the sealing strip 22 extends beyond at least one and preferably both of the opposite ends of the support member 21. As illustrated in FIG. 1, the sealing strip 22 presents strip ends 39 extending beyond both of the opposite ends 40 of the rigid support member 21. As illustrated in FIG. 3, this construction permits adjacent closure sealing members 20A, 20B and 20B, 20C to be angularly presented with the adjacent strip ends 39 thereof in abutted relation to form neat joints **41*a*, 41*b*. At each of the joints 41, the confronting ends 40 of the adjacent support members 21** are entirely spaced-apart.

Figure 5:
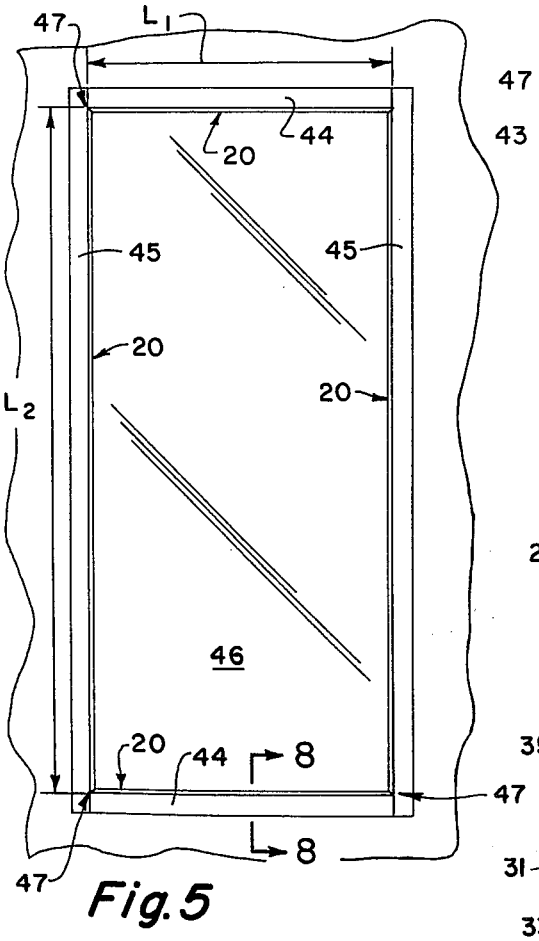
FIGS. 5 and 6 are fragmentary elevation views of typical fixed frame assemblies incorporating the closure sealing members of this invention.
Figure 6:
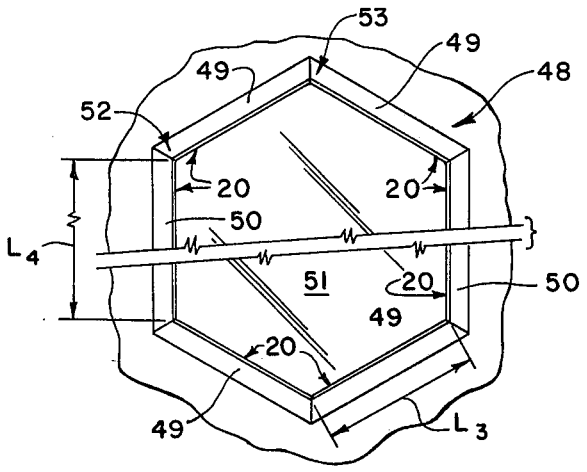

The advantage of having the strip ends 39 extending beyond the rigid support ends 40 will now become apparent from the following description. FIG. 5 illustrates a fixed frame assembly 43 of polygonal configuration (rectangular) having plural angularly presented frame members 44 of length $L_1$ and 45 of length $L_2$, surrounding a closure 46. The frame assembly 43 presents plural interior corners 47 each presented at a juncture of adjacent ones of the angularly disposed frame members 44, 45. FIG. 6 illustrates a fixed frame assembly of a different polygonal configuration, having plural, angularly presented frame members 49 of length $L_3$ and 50 of length $L_4$ surrounding a closure 51. The frame assembly 48 presents plural interior corners 52, each presented at the juncture of adjacent ones of the angularly disposed frame members 49, 50; and interior corners 53, each presented at the juncture of adjacent ones of the angularly disposed frame members 49. As will be described, the closures 46, 51 cooperate with the frame members 44, 45 and 49, 50, respectively to define contiguous perimeter recesses at at least one assembly face — each of the perimeter recesses receiving one of the closure sealing members 20. In accordance with the present invention, the overall length L (FIG. 1) of each of the closure sealing members 20 corresponds substantially to the length $L_1$, $L_2$, $L_3$, $L_4$ or the frame members 44, 45, 49 and 50.

Figure 7:
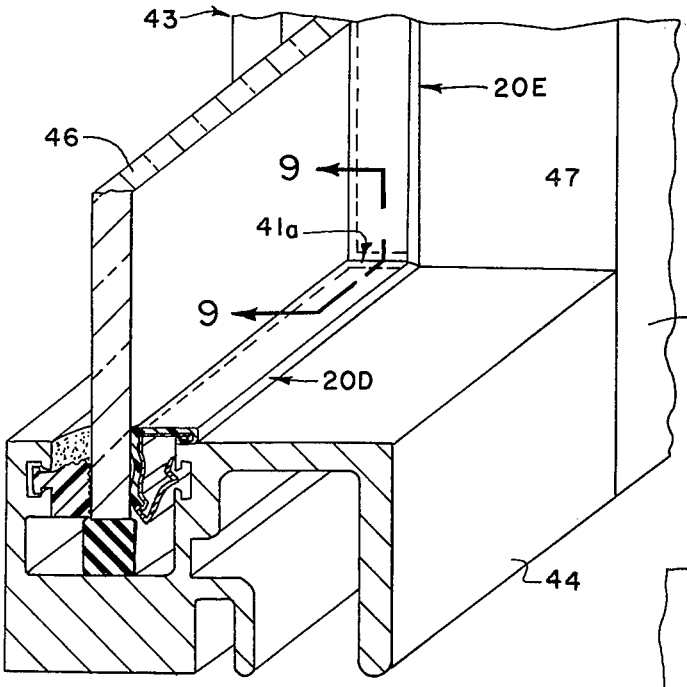
FIG. 7 is a fragmentary isometric view, partly in cross-section, illustrating a corner configuration of the fixed frame assembly of FIG. 5.

In FIG. 7, the horizontal and vertical closure sealing members are identified by the numerals 20D and 20E, respectively. The sealing members 20D, 20E meet at the juncture 47 of the frame elements 44, 45 to provide the joint **41*a***.

Figure 8:
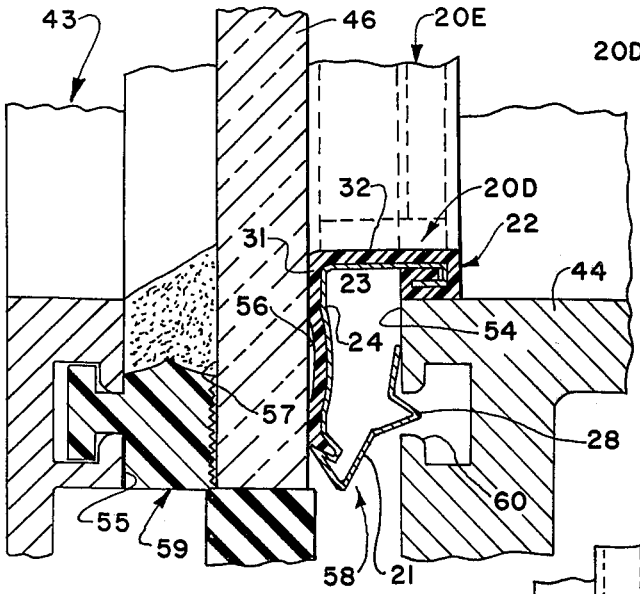
FIG. 8 is a cross-sectional view, taken along the line 8—8 of FIG. 7, illustrating one method of forming a corner between the sealing strips of adjacent closure sealing members.

It will be observed in FIG. 8 that the frame member 44 presents inner faces 54, 55. The frame members 45 have similar inner faces which are not visible in FIG. 8. The inner faces 54, 55 cooperate with the opposite faces 56, 57 of the closure 46 to define contiguous perimeter recesses 58, 59. In FIGS. 7 and 8, the closure sealing members 20D, 20E are presented on the interior of the fixed frame assembly 43. As best shown in FIG. 8, the first arm 23 of the sealing member 20D is presented in capping relation with the recess 58. The second arm 24 extends into the recess 58. The first portion 31 of the sealing strip 22 is compressed between the inner face 56 of the closure 46 and the first arm 24 of the support member 21. The second portion 32 of the sealing strip 22 is exposed to view. The deflectible arm 21 engages the inner face 54 of the frame member 44 and has its rib 28 extending into a locking recess 60 provided in the frame member 44. The retaining arm 21, in its deflected position, urges the rigid support member 21 toward the closure 46, thereby compressing the first portion 31 of the sealing strip 22 between the support member 21 and the closure 46. Hence the present closure sealing member 20 is capable of accommodating large tolerances in the thickness of the closure 46.

Figure 9:
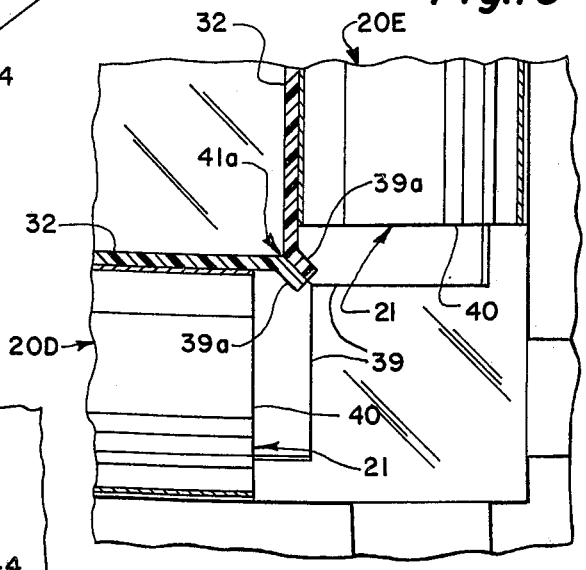
FIG. 9 is a cross-sectional view, similar to FIG. 8, illustrating an alternative method of forming a corner between the sealing strips of adjacent closure sealing members.

It will be observed in FIG. 9 that the joint **41*a* between the sealing members 20D and 20E may be formed by tucking-in the strip ends 39*a* of the second strip portions 32. No field cutting is required in forming the joint 41*a* in this manner. Alternatively, as shown in FIG. 10, the joint 41*a*′ between the sealing members 20D, 20E may be formed by field cutting an end segment of the second strip portion 32 of one of the sealing members, for example, the sealing member 20E**.

The strip in 39*a* of the second portion 32 (sealing member 20D) remains intact and engages the end of the second portion 32 of the sealing member 30E, thereby to provide the neat joint 41*a*′.

Figure 10:
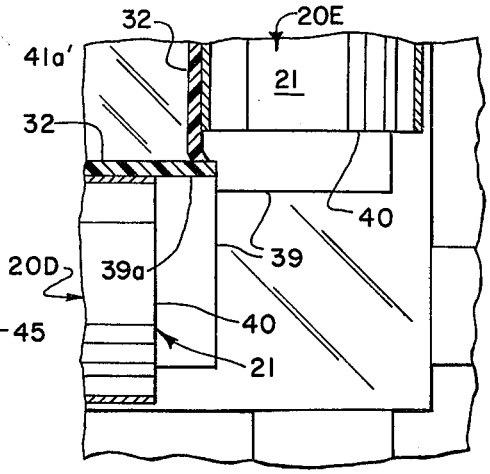
FIG. 10 is a cross-sectional view, taken along the line 10—10 of FIG. 5.

It will be observed in FIGS. 9 and 10 that the confronting ends 40 of the adjacent rigid support members 21 are spaced-apart. Thus each of the rigid support members 21 is free to undergo thermal expansion and contraction without affecting the joint 41*a*, 41*a*′.

Figure 11:
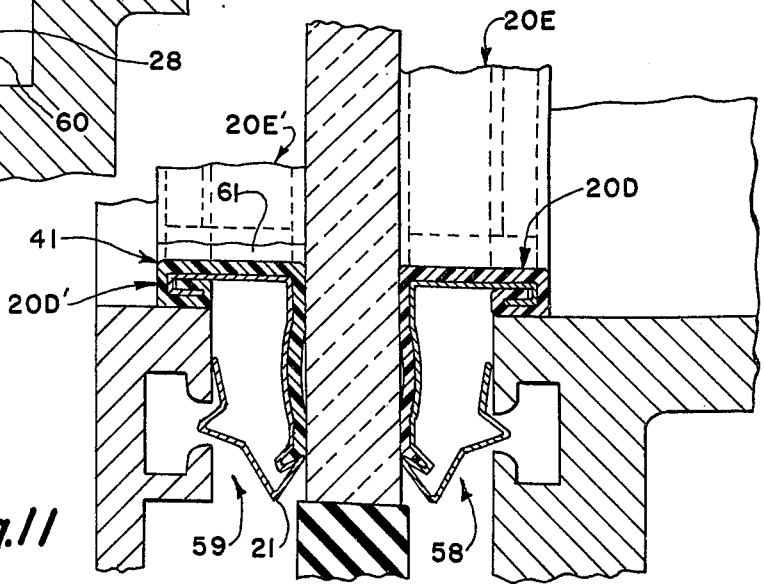
FIG. 11 is a cross-sectional view, similar to FIG. 10, illustrating the use of the present closure sealing member exteriorly and interiorly of the fixed frame assembly.

The present closure sealing member may also be used exteriorly of the fixed frame assembly. As illustrated in FIG. 11, closure sealing elements 20D′ and 20E′ are received in the exterior, contiguous perimeter recesses 59. When used externally, the rigid support members 21 preferably are formed from corrosion resistant material such as stainless steel. In addition, a bead 61 of sealant material preferably is provided at each of the joints 41, thereby to insure a weather tight seal.

It will be appreciated that since the support member is longitudinally rigid, installation portions need only be applied at intervals of 8 to 10 inches along the length of the sealing closure member during installation. Hence, the time required to install the present closure sealing member is considerably less than the time required to install prior art rubber beads — the resilient character of the beads requiring installation forces to be applied every one-half inch to one inch in order to drive it into the perimeter recess.

I claim:

1. In a fixed frame assembly of polygonal configuration, having plural, angularly presented frame members surrounding a closure, said frame members including inner perimeter faces confronting said closure and defining contiguous perimeter recesses at one assembly face, and exposed perimeter faces at said one assembly face; said frame assembly having plural interior corners, each presented at the juncture of adjacent ones of said angularly disposed frame members; the improvement comprising:

sealing members, one presented in coextensive capping relation with each of said recesses, said sealing members including longitudinally rigid support members frictionally retained in said capping relation by interlocking engagement with said inner perimeter faces of said frame members, said support members including first arms extending into said perimeter recesses and second arms integral with said first arms and extending therefrom over said exposed perimeter faces of said frame members; and sealing strips having first portions compressed between said closure and the first arms of said support members, and second portions overlying said second arms and being substantially coextensive in area therewith, the second portions of the sealing strips of adjacent sealing members having strip ends engaged with each other and providing a neat exposed joint at each of said junctures;

the ends of the support members of adjacent ones of said sealing members being entirely spaced-apart from each other and being inwardly offset from the strip ends of the sealing strips.

2. The improvement of claim 1 wherein each of said support members includes:

a deflectible retaining arm integral with the second arm and being inclined relative to the second arm so as to form an acute angle therewith, said deflectible retaining arm being frictionally engaged with the inner perimeter face of the adjacent frame member.

3. The improvement of claim 2 wherein each of said frame members is provided with a locking recess presented at the inner perimeter face thereof; and wherein said deflectible retaining arm includes a lengthwise rib extending away from said interior face of said angle member into said locking recess.

* * * * *